United States Patent [19]

Hutten

[11] Patent Number: 4,629,075

[45] Date of Patent: Dec. 16, 1986

[54] MOUNTING STRIP

[75] Inventor: James E. Hutten, Mason, Ohio

[73] Assignee: Ghent Manufacturing Inc., Lebanon, Ohio

[21] Appl. No.: 770,604

[22] Filed: Aug. 29, 1985

[51] Int. Cl.[4] ..... A47F 5/08

[52] U.S. Cl. ..... 211/89; 211/45

[58] Field of Search ..... 211/89.45, 87, 94, 57.1, 211/88; 248/316.2, 316.3, 316.5, 225.1

[56] References Cited

U.S. PATENT DOCUMENTS

| | | | |
|---|---|---|---|
| 773,392 | 10/1904 | Holsapple . | |
| 1,165,108 | 12/1915 | Memmler . | |
| 2,530,821 | 11/1950 | Hubbell | 211/45 X |
| 2,785,919 | 3/1957 | Grondzik | 211/89 X |
| 2,964,197 | 12/1960 | Wallace . | |
| 3,591,013 | 7/1971 | Herrmann | 211/89 X |
| 3,914,892 | 10/1975 | Mohr . | |
| 4,010,517 | 3/1977 | Kapstad | 211/45 X |
| 4,085,848 | 4/1978 | Tsuge . | |
| 4,105,127 | 8/1978 | Holl . | |
| 4,194,635 | 3/1980 | Ferrara | 211/45 |
| 4,405,051 | 9/1983 | Thalenfeld | 211/57.1 |

FOREIGN PATENT DOCUMENTS

| | | | |
|---|---|---|---|
| 321456 | 7/1957 | Switzerland | 211/45 |
| 2025218 | 1/1980 | United Kingdom | 211/94 |

*Primary Examiner*—Robert W. Gibson, Jr.

*Attorney, Agent, or Firm*—Wood, Herron & Evans

[57] ABSTRACT

A mounting strip for clamping flexible sheet material or other objects includes an elongated U-shaped, rigid plastic channel having a forward leg forming a bearing surface and a rearward leg forming a mounting surface. An elongated flexible gripper tongue is formed along the mounting surface of the channel and includes a clamping surface adapted to engage the bearing surface of the forward leg of the channel for receiving and clamping an article such as sheet material therebetween. The rigid plastic channel and flexible plastic gripper tongue are preferably co-extruded in a single operation to form a one-piece mounting strip having cooperating clamping elements with different durometer hardnesses.

6 Claims, 2 Drawing Figures

MOUNTING STRIP

BACKGROUND OF THE INVENTION

This invention relates to holders, and, more particularly, to elongated mounting strips for supporting objects such as flexible sheet material.

Clamping or holding devices for supporting objects such as flexible sheet material generally include an elongated frame or housing adapted to mount to a surface, and a clamping element which cooperates with the housing to releasably clamp the sheet material thereto. Clamping devices of this general type are commonly fabricated in elongated strips which are mounted, for example, to the walls of a classroom, office, or conference room.

A primary consideration in the production of clamping devices of the type described above is to limit manufacturing and fabrication costs without sacrificing their ability to firmly and releasably grip flexible sheet material. One problem with such prior art devices is that the housing and clamping element are formed in separate manufacturing operations, and then later assembled to form the completed clamping device. Separate fabrication operations increases manufacturing costs and capital expenditures for the equipment. The cost of the device is further increased by the separate assembly operation required to connect the clamping element and housing.

Another problem with many prior art clamping devices for flexible sheet material is that while the sheet may be inserted directly between the housing and clamping element, it can be removed only by sliding the sheet endwise to one of the ends of the housing and clamping element. This is particularly disadvantageous where the clamping device is fabricated in an elongated strip because the flexible sheet material must be moved a large distance to reach the end of the housing and clamping element for removal.

SUMMARY OF THE INVENTION

In a broad aspect of this invention, an elongated mounting strip is provided for releasably clamping an object, such as flexible sheet material, between cooperating surfaces of a rigid channel and a flexible gripper tongue which are integrally formed in one piece in a single manufacturing operation. Although flexible sheet material is discussed as one object supported by the mounting strip herein to illustrate the concept of this invention, it is contemplated that other objects could be clamped or secured by the mounting strip to create, for example, weather-tight or insulative seals.

More specifically, the mounting strip of this invention includes an elongated, rigid plastic channel having a bearing surface and a mounting surface. An elongated, flexible plastic gripper tongue is integrally formed along the mounting surface of the channel, and includes a clamping surface which engages the bearing surface of the channel. Objects are insertable between the bearing surface of the channel and clamping surface of the gripper tongue along an axis generally perpendicular to the longitudinal axes of the channel and gripper tongue, and are removable from between such surfaces by pulling the object along the same insertion axis. This is in contrast to prior art clamping devices in which the clamped object, such as sheet material, must be removed endwise from between the clamping member and housing or frame.

In a further aspect of this invention, the mounting strip herein is integrally formed preferably in a single operation by co-extruding two materials having a different durometer hardness to form an integral, one-piece strip. One of the materials of the extrusion is a rigid plastic, such as rigid polyvinyl chloride, which forms the channel with its elongated bearing surface and elongated mounting surface. The other material is a flexible plastic, such as soft polyvinyl chloride, which forms the gripper tongue. The rigid polyvinyl chloride and soft polyvinyl chloride are co-extruded in a single operation so that the gripper tongue is integrally formed along the length of the mounting surface of the channel to form a mounting strip of one piece construction. It is also contemplated that the mounting strip herein could also be integrally formed in a one-piece structure by gluing or molding the channel and gripper tongue together.

In a presently preferred embodiment, the gripper tongue is formed with an arcuate clamping surface adapted to engage the bearing surface of the channel along its entire length. The clamping surface of the gripper tongue and bearing surface of the channel thus cooperate to form a clamping member for receiving and supporting objects therebetween. Objects are removed from the clamping member by pulling downwardly along the same axis in which they were inserted into the clamping member.

In a more specific aspect of this invention, the rigid plastic channel is preferably formed in a U-shape having a rearward leg forming the mounting surface of the mounting strip, and a forward leg spaced from the rearward leg and disposed substantially parallel thereto which forms the bearing surface of the mounting strip. The elongated forward and rearward legs are connected by an intermediate leg to complete the U-shape cross section of the channel. Preferably, the rearward leg is formed with a slot adapted to receive fasteners such as screws for mounting the mounting strip to a surface such as a wall.

The mounting strip of this invention is economical to manufacture compared to prior art clamping devices because the channel and gripper tongue, having dual-durometer hardnesses, are integrally formed as a single extrusion. This eliminates the separate manufacturing operations required to fabricate the housing and clamping elements of prior art devices, as well as the additional step needed in such prior art devices to assemble the housing and clamping element.

In addition, the mounting strip herein is adapted to receive objects, such as flexible sheet materials, along an insertion axis extending between the bearing surface of the channel and clamping surface of the gripper tongue. The clamped object can then be removed from between such surfaces by pulling downwardly along the same insertion axis, rather than sliding the object endwise along the channel and gripper tongue as required in many prior art clamping devices.

DESCRIPTION OF THE DRAWINGS

The structure, operation and advantages of a presently preferred embodiment of this invention will become further apparent upon consideration of the following discussion taken in conjunction with the accompanying drawings, wherein.

DETAILED DESCRIPTION OF THE INVENTION

Figure 1:
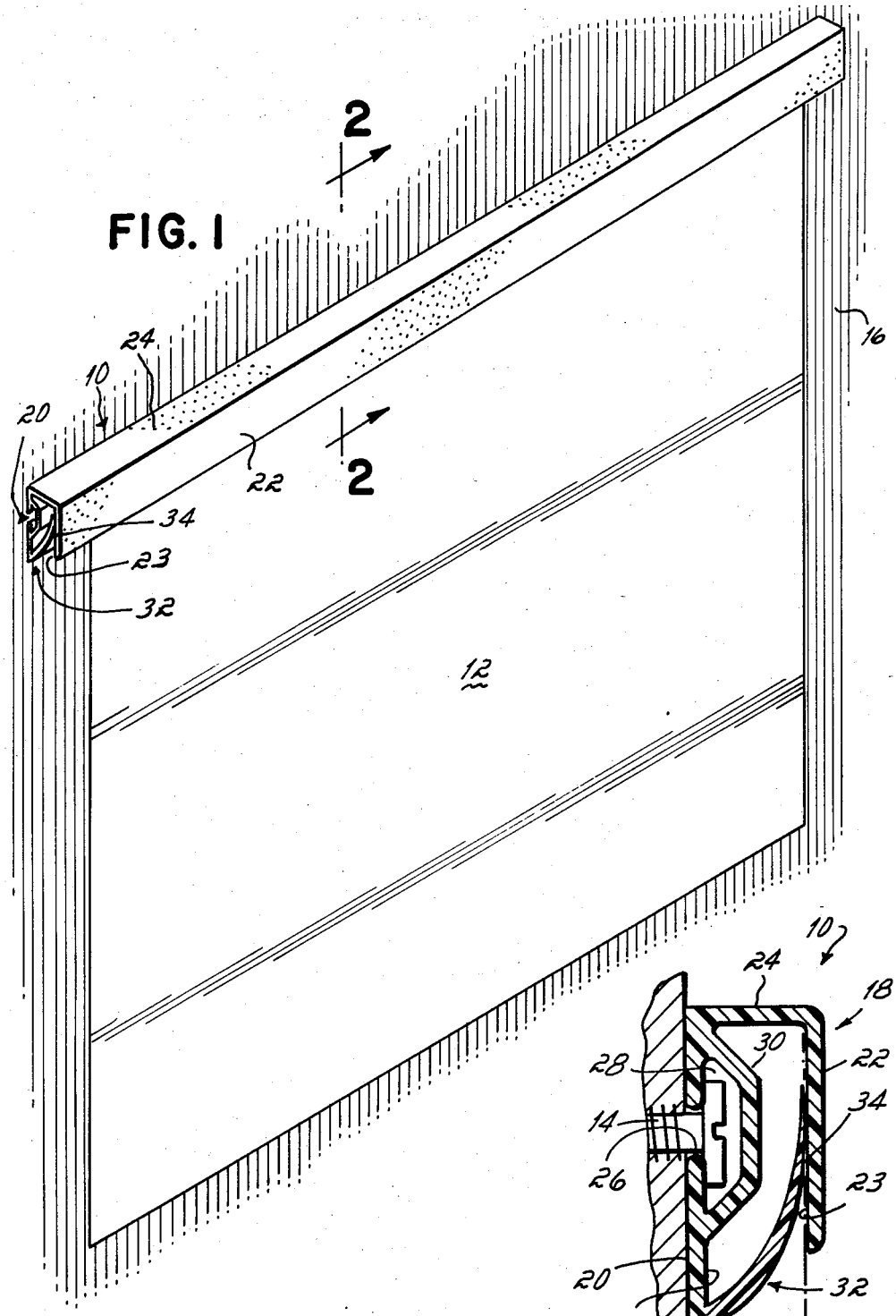
FIG. 1 is a perspective view of the mounting strip of this invention shown in an application for mounting flexible sheet material to a wall.
Figure 2:
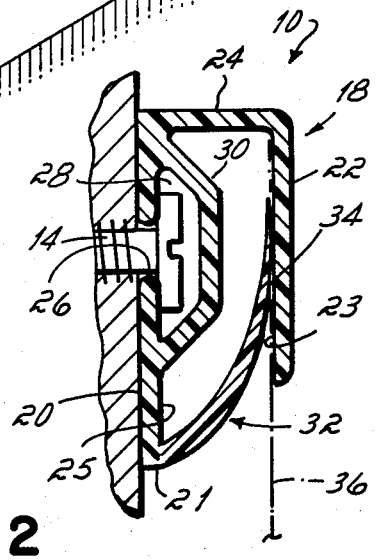
FIG. 2 is a cross sectional view of the mounting strip herein taken generally along line 2—2 of FIG. 1.

Referring now to the drawings, a mounting strip 10 according to this invention is shown supporting a sheet 12 of paper or similar flexible sheet material. The mounting strip 10 is secured by a plurality of screws 14, one of which is shown in FIG. 2, to a planar surface such as a wall 16. It should be understood that the mounting strip 10 of this invention could be utilized to clamp or support objects other than a flexible sheet 12, such as glass, wood or other materials. In addition to its clamping capability, the mounting strip 10 could also be used to create a weather-tight or insulative seal in certain applications. The mounting strip 10 is therefore illustrated in the drawings as providing a support for a flexible sheet 12 only for purposes of describing the inventive concept herein, and is not limited to such application.

The mounting strip 10 includes a U-shaped channel 18 having an elongated rearward leg 20, an elongated forward leg 22 disposed parallel to and spaced from the rearward leg 20 and an intermediate leg 24 which connects the rearward leg 20 to the forward leg 22. In one presently preferred embodiment of this invention, the rearward leg 20 is formed with an elongated slot 26 disposed within a cavity 28 formed by a cover member 30 which extends outwardly from the rearward leg 20 toward the forward leg 22. The slot 26 is adapted to receive the screws 14 for mounting the mounting strip 10 to wall 16. It is contemplated that other fasteners could be used to secure mounting strip 10 to a surface such as magnets, bolts, nails and the like.

The flexible sheet 12 is clamped or sealed within the mounting strip 10 by the cooperation of the forward leg 22 of channel 18, having an inner face which forms a bearing surface 23, and a flexible, gripper tongue 32. One end of the gripper tongue 32 extends along the lower edge 21 of rearward leg 20, which forms a mounting surface 25 for the gripper tongue 32. The other end of the gripper tongue 32 includes an arcuate exterior surface forming a clamping surface 34 which engages the bearing surface 23 of the forward leg 22.

The flexible gripper tongue 32 is preferably preloaded against the inside or bearing surface 23 of forward leg 22 so as to exert at least slight pressure thereagainst. The arcuate clamping surface 34 of the gripper tongue 32, and bearing surface 23 of the forward leg 22 of channel 18, cooperate to receive and clamp the flexible sheet 12 therebetween. The sheet 12 is inserted directly between the clamping surface 34 and the bearing surface 23 along an insertion axis 36 which is generally perpendicular to the longitudinal axes of the channel 18 and gripper tongue 32. The flexibility of gripper tongue 32 also permits the removal of sheet 12 from the mounting strip 10 by pulling downwardly on the sheet 12 along the insertion axis 36 without dislodging the gripper tongue 32 from its position between the legs 20, 22 of the channel 18.

In a presently preferred embodiment of this invention, the channel 18 and gripper tongue 32 are integrally formed in a single extrusion or co-extrusion operation as a one piece assembly. The channel 18 is preferably formed of rigid plastic and the gripper tongue 32 is formed of soft, flexible plastic having a hardness much less than that of the channel 18. The single extrusion operation in which the gripper tongue 32 is integrally formed along the mounting surface 25 of the rearward leg 20, therefore produces a one-piece mounting strip 10 having clamping elements with dual durometer hardnesses. Both the channel 18 and gripper tongue 32 may be formed of polyvinyl chloride of differing durometer hardness, or other suitable materials of dual durometer hardnesses so long as the channel 18 is rigid and the gripper tongue 32 is flexible.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A mounting strip comprising:

a one-piece rigid plastic channel and flexible plastic tongue, said channel having a hardness substantially greater than the hardness of said tongue;

said channel being formed with an elongated bearing surface, and an elongated mounting surface spaced from said elongated bearing surface;

said tongue and said channel being co-extruded so that said tongue is integrally formed along said elongated mounting surface of said channel, said tongue having a clamping surface engaging said elongated bearing surface of said channel for releasably clamping objects therebetween.

2. The mounting strip of claim 1 in which said channel is formed in a U-shape, said bearing surface being substantially parallel to and spaced from said mounting surface.

3. The mounting strip of claim 1 in which said channel includes mounting means for securing said mounting strip to a surface.

4. The mounting strip of claim 3 in which said mounting means comprises a slot formed in said mounting surface, said slot being adapted to receive fasteners for securing said mounting strip to a surface.

5. The mounting strip of claim 1 in which said clamping surface of said tongue is formed with an arcuate, outer surface for engaging said bearing surface of said channel.

6. The mounting strip of claim 1 in which said rigid plastic channel is formed of polyvinyl chloride and said flexible plastic tongue is formed of polyvinyl chloride, said polyvinyl chloride forming said flexible plastic tongue having a different durometer hardness than said polyvinyl chloride forming said rigid plastic channel.

* * * * *